US011205388B2

(12) United States Patent
Im et al.

(10) Patent No.: US 11,205,388 B2
(45) Date of Patent: Dec. 21, 2021

(54) DISPLAY DEVICE AND RELATED OPERATING METHOD

(71) Applicant: Samsung Display Co., Ltd., Yongin-Si (KR)

(72) Inventors: Ki Ju Im, Yongin-si (KR); Jong Woo Park, Yongin-si (KR); Hyun Cheol Hwang, Yongin-si (KR)

(73) Assignee: Samsung Displav Co., Ltd.

( * ) Notice: Subject to any disclaimer, the term of this patent is extended or adjusted under 35 U.S.C. 154(b) by 36 days.

(21) Appl. No.: 16/869,482

(22) Filed: May 7, 2020

(65) Prior Publication Data

US 2021/0134227 A1 May 6, 2021

(30) Foreign Application Priority Data

Oct. 30, 2019 (KR) ..... 10-2019-0136797

(51) Int. Cl.
*G09G 3/3266* (2016.01)

(52) U.S. Cl.
CPC ..... *G09G 3/3266* (2013.01); *G09G 2310/06* (2013.01); *G09G 2320/0233* (2013.01)

(58) Field of Classification Search
None
See application file for complete search history.

(56) References Cited

U.S. PATENT DOCUMENTS

2018/0025683 A1 1/2018 Oh et al.

FOREIGN PATENT DOCUMENTS

| | | | |
|---|---|---|---|
| CN | 106652915 | A | 5/2017 |
| KR | 10-2015-0025538 | A | 3/2015 |
| KR | 10-2015-0104241 | A | 9/2015 |

*Primary Examiner* — Aneeta Yodichkas
(74) *Attorney, Agent, or Firm* — Innovation Counsel LLP

(57) ABSTRACT

A method of operating a display device may include the following steps: in a first frame period, before turning off a gate initialization transistor, changing an initialization voltage from a first level to a second level and subsequently returning the initialization voltage to the first level; in a second frame period, before turning off the gate initialization transistor, changing the initialization voltage from the first level to the second level and/or a third level and subsequently returning the initialization voltage to the first level. The display device may include the gate initialization transistor and a driving transistor. A first electrode the gate initialization transistor may receive the initialization voltage. A second electrode of the gate initialization transistor may be electrically connected to a gate electrode of the driving transistor. The first level, the second level, and the third level may be unequal to each other.

20 Claims, 14 Drawing Sheets

DISPLAY DEVICE AND RELATED OPERATING METHOD

This application claims priority to and benefit of Korean Patent Application No. 10-2019-0136797, filed on Oct. 30, 2019; the content of the Korean Patent Application is incorporated by reference.

BACKGROUND

1. Field

The technical field relates to a display device and a method of operating the display device.

2. Description of the Related Art

A display device may display images and/or videos. A modern display device may be, for example, one of a liquid crystal display device (LCD), an organic light emitting display device (OLED), and a plasma display panel (PDP).

An organic light emitting diode display may include pixels arranged in a matrix form. A pixel may include an organic light emitting diode and a driving transistor for controlling current flowing to the organic light emitting diode. A pixel may emit light of a predetermined luminance according to a data voltage.

If some pixels of display device emit light of insufficient luminance during a predetermined frame period, a displayed image may not have sufficient luminance uniformity. As a result, the image/video quality may be unsatisfactory.

In a pixel, a threshold voltage of the driving transistor may be shifted in correspondence with a voltage applied to the driving transistor in a previous frame period, and light of insufficient luminance may be emitted in a current frame because of the shifted threshold voltage. Additionally or alternatively, hysteresis of the driving transistor may lead to insufficient luminance. As a result, the image/video quality may be unsatisfactory.

SUMMARY

Embodiments may be related to a display device and a method of driving/operating the display device. The method may enable the display device to display an image of a desired luminance in correspondence with a grayscale and may satisfactorily maintain luminance uniformity of the display device.

A method of driving a display device according to an embodiment for resolving the above-described object is a method, in which an initialization voltage providing step of providing an initialization voltage to a gate electrode of a driving transistor, and a data signal providing and threshold voltage compensation step of providing a data signal to a source or drain electrode of the driving transistor are sequentially started for each frame period, including a first frame period in which an initialization voltage of a first voltage level is provided and the initialization voltage is offset to a second voltage level immediately before the initialization voltage of the first voltage level is provided, in the initialization voltage providing step, and a second frame period in which the initialization voltage of the first voltage level is provided and the initialization voltage is offset to a third voltage level immediately before the initialization voltage of the first voltage level is provided, in the initialization voltage providing step.

A first scan signal of a turn-on level may be supplied to a pixel through a first scan line in the initialization voltage providing step, and a second scan signal of a turn-on level may be supplied to the pixel through a second scan line in the data signal providing and threshold voltage compensation step.

In the first frame period, before maintenance of the supply of the first scan signal of the turn-on level is ended, the initialization voltage may be offset to the second voltage level and maintains the first voltage level again.

In the first frame period, before the supply of the first scan signal of the turn-on level starts, the initialization voltage may start the offset of the second voltage level.

In the first frame period, while the supply of the first scan signal of the turn-on level is maintained, the initialization voltage may be offset to the second voltage level.

The first voltage level, the second voltage level, and the third voltage level may be different from each other.

The second voltage level may be a voltage level offset in a negative direction from the first voltage level, and the third voltage level may be a voltage level offset in a positive direction from the first voltage level.

The first frame period and the second frame period may alternate.

Degrees (absolute values) at which the second voltage level and the third voltage level are offset from the first voltage level may be equal to each other.

The first voltage level may be −5 V to −3 V, the second voltage level may be −11 V to −9 V, and the third voltage level may be 0 V to 2 V.

The first frame period may be successive at least twice and the second frame period may be successive at least twice.

In the first frame period, the initialization voltage may be offset to the third voltage level immediately before the initialization voltage of the first voltage level is provided and then offset to the second voltage level, and in the second frame period, the initialization voltage may be offset to the second voltage level immediately before the initialization voltage of the first voltage level is provided and then offset to the third voltage level.

The method may further include an anode compensating step of providing the initialization voltage to an anode of a light emitting diode, which starts after the data signal providing and threshold voltage compensating step is started.

A third scan signal of a turn-on level may be supplied to the pixel through a third scan line in the anode compensating step.

The initialization voltage may be maintained at the first voltage level in the anode compensating step.

A period in which the third scan signal of the turn-on level is supplied through the third scan line and a period in which the initialization voltage is offset to the second voltage level or a period in which the initialization voltage is offset to the third voltage level may not overlap.

A display device according to another embodiment for resolving the above-described object includes a display unit including a plurality of pixels, a scan driver connected to each of the pixels through a plurality of scan lines, a data driver connected to each of the pixels through one data line, and a power supply connected to each of the pixels through an initialization line and including an initialization voltage generator configured to provide an initialization voltage for initializing a gate electrode of a driving transistor in each of the pixels, to each of the pixels. The initialization voltage generator provides an initialization voltage of a first voltage level to the driving transistor during a first frame period, offsets the initialization voltage to a second voltage level immediately before the initialization voltage of the first voltage level is provided, provides the initialization voltage of the first voltage level to the driving transistor during a second frame period, and offsets the initialization voltage to a third voltage level immediately before the initialization voltage of the first voltage level is provided.

The second voltage level may be a voltage level offset in a negative direction from the first voltage level, and the third voltage level may be a voltage level offset in a positive direction from the first voltage level.

The initialization voltage generator may provide the initialization voltage for initializing an anode of a light emitting diode in each of the pixels to the first voltage level, to each of the pixels, in each of the first frame period and the second frame period.

The gate electrode of the driving transistor may be initialized to the first voltage level before the anode of the light emitting diode is initialized to the first voltage level, in each of the first frame period and the second frame period.

An embodiment may be related to a method of operating a display device. The method may include the following step: in a first frame period, before changing a gate initialization transistor from on to off, changing an initialization voltage from a first voltage level to a second voltage level and subsequently returning the initialization voltage to the first voltage level. The second voltage level may be unequal to the first voltage level. The display device may include the gate initialization transistor and a driving transistor. A first electrode the gate initialization transistor may receive the initialization voltage. A second electrode of the gate initialization transistor may be electrically connected to a gate electrode of the driving transistor. The method may include the following step: in a second frame period, before changing the gate initialization transistor from on to off, changing the initialization voltage from the first voltage level to at least one of the second voltage level and a third voltage level and subsequently returning the initialization voltage to the first voltage level. The third voltage level may be unequal to each of the first voltage level and the second voltage level.

The method may include the following steps: in the first frame period, after changing the gate initialization transistor from off to on, changing a scan transistor from off to on. The display device may include the scan transistor and a data line. A first electrode of the scan transistor may be electrically connected to the data line; and in the first frame period, maintaining the initialization voltage at the first voltage level when the scan transistor is on.

The method may include the following step: in the first frame period, before changing the initialization voltage from the first voltage level to the second voltage level, changing the gate initialization transistor from off to on.

The method may include the following step: in the first frame period, after changing the initialization voltage from the first voltage level to the second voltage level, changing the gate initialization transistor from off to on.

The method may include the following step: in the first frame period, after changing the gate initialization transistor from off to on, changing the initialization voltage from the second voltage level to the first voltage level.

In the first frame period, the gate initialization transistor may remain on for longer time than the initialization voltage remains at the second voltage level.

The at least one of the second voltage level and the third voltage level may include the third voltage level. The second voltage level may be lower than the first voltage level. The third voltage level may be higher than the first voltage level.

The at least one of the second voltage level and the third voltage level may be the third voltage level. The first frame period may immediately precede the second frame period.

The at least one of the second voltage level and the third voltage level may include the third voltage level. A difference between the second voltage level and the first voltage level may be equal to a difference between the third voltage level and the first voltage level.

The at least one of the second voltage level and the third voltage level may include the third voltage level. The first voltage level may be in a range of −5 V to −3 V. The second voltage level may be in a range of −11 V to −9 V. The third voltage level may be in a range of 0 V to 2 V.

The first frame period may immediately precede the second frame period. The at least one of the second voltage level and the third voltage level may be the second voltage level.

The method may include the following steps: in the first frame period, changing the initialization voltage from the second voltage to the third voltage level and subsequently changing the initialization voltage from the third voltage level to the first voltage level; and in the second frame period, changing the initialization voltage from the third voltage level to the second voltage level and subsequently changing the initialization voltage from the second level to the first voltage level. The second frame period may immediately follow the first frame period.

The method may include the following step: in the first frame period, after changing the gate initialization transistor from off to on, changing an anode initialization transistor from off to on. The display device may include the anode initialization transistor and a light emitting diode. A first electrode of the anode initialization transistor may be electrically connected to an anode of the light emitting diode.

The method may include the following step: in the first frame period, before changing the anode initialization transistor from off to on, changing a scan transistor from off to on. The display device may include the scan transistor and a data line. A first electrode of the scan transistor may be electrically connected to the data line.

The method may include the following step: in the first frame period, maintaining the initialization voltage at the first voltage level when the anode initialization transistor may be on.

In the first frame period, the initialization voltage may be changed from the first voltage level to the second voltage level and returned to the first voltage level before the anode initialization transistor is changed from off to on.

An embodiment may be related to a display device. The display device may include a display unit, a scan driver, and an initialization voltage generator. The display unit may include a driving transistor and a gate initialization transistor. The scan driver may be electrically connected to a gate electrode of the gate initialization transistor. The initialization voltage generator may be electrically connected to a first electrode of the gate initialization transistor and may provide an initialization voltage to the first electrode of the gate initialization transistor. A second electrode of the gate initialization transistor may be electrically connected to a gate electrode of the driving transistor. In a first frame period, before the scan driver changes the gate initialization transistor from on to off, the initialization voltage generator may change the initialization voltage from a first voltage level to a second voltage level and may subsequently return the initialization voltage to the first voltage level. The second voltage level may be unequal to the first voltage level. In a second frame period, before the scan driver changes the gate initialization transistor from on to off, the initialization voltage generator may change the initialization voltage from the first voltage level to at least one of the second voltage level and a third voltage level and may subsequently return the initialization voltage to the first voltage level. The third voltage level may be unequal to each of the first voltage level and the second voltage level.

The at least one of the second voltage level and the third voltage level may include the third voltage level. The second voltage level may be lower than the first voltage level. The third voltage level may be higher than the first voltage level.

The display unit may include an anode initialization transistor and a light emitting diode. A first electrode of the anode initialization transistor may be electrically connected to an anode of the light emitting diode. In the first frame period, after the scan driver changes the gate initialization transistor from off to on, the scan driver may change the anode initialization transistor from off to on. In the first frame period, the initialization voltage generator may maintain the initialization voltage at the first voltage level when the anode initialization transistor is on.

The gate electrode of the driving transistor may be initialized to the first voltage level before the anode of the light emitting diode is initialized to the first voltage level in each of the first frame period and the second frame period.

According to embodiments, a display device may display an image of a desired luminance in correspondence with a grayscale; the display may minimize degradation of uniformity of a luminance. Therefore, an afterimage may be minimized and may not be perceived by a user.

DETAILED DESCRIPTION

Figure 1:
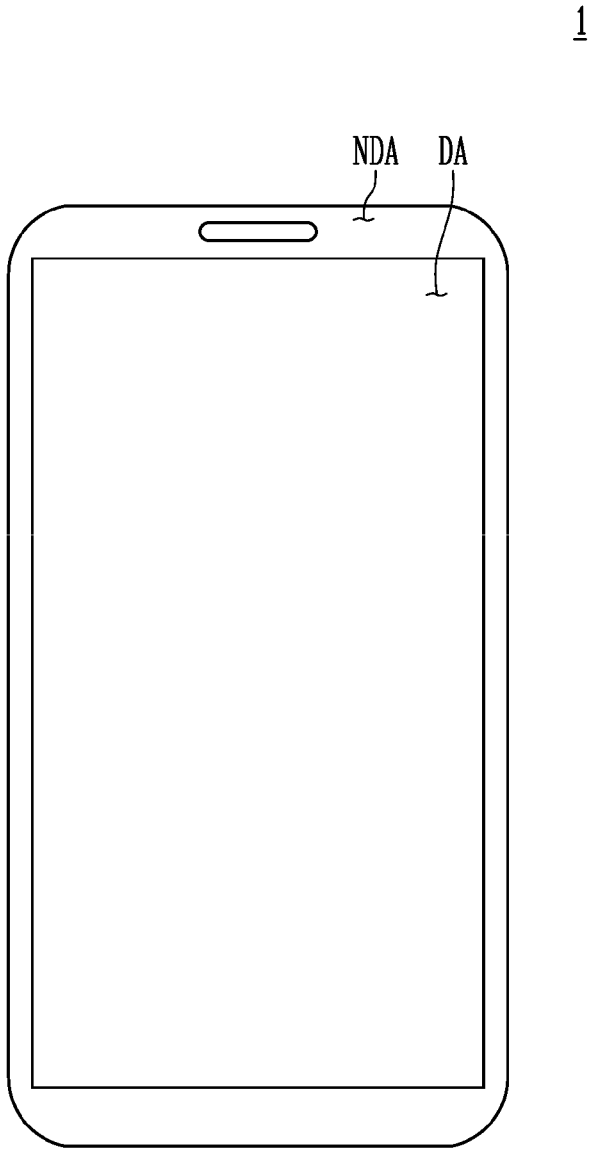
FIG. 1 is a plan view schematically illustrating a display device according to an embodiment.

Example embodiments are described with reference to the accompanying drawings. Practical embodiments may be implemented in various forms.

Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

When a first element is referred to as "on" a second element, the first element may be disposed directly or indirectly on the second element.

The same reference numerals may denote the same or analogous components.

Singular expressions may represent plural expressions unless the context clearly dictates otherwise. The term "connect" may mean "electrically connect." The term "insulate" may mean "electrically insulate" or "electrically isolate." The term "drive" may mean "operate" or "control." The term "offset" may mean "set," "adjust," or "change."

FIG. 1 is a plan view schematically illustrating a display device according to an embodiment.

Referring to FIG. 1, the display device 1 may include a display area DA and a non-display area NDA.

The display area DA may display different images. The display area DA may also detect user input and/or an external environment. For example, the display area DA may recognize a fingerprint or a touch of a user. The display area DA may have a flat shape. At least some areas of the display area DA may be bent.

The non-display area NDA is disposed outside the display area and may not display different images. At least one of a speaker module, a camera module, a sensor module, and the like may be disposed in the non-display area NDA. The sensor module may include at least one of an illumination sensor, a proximity sensor, an infrared sensor, and an ultrasonic sensor.

Figure 2:
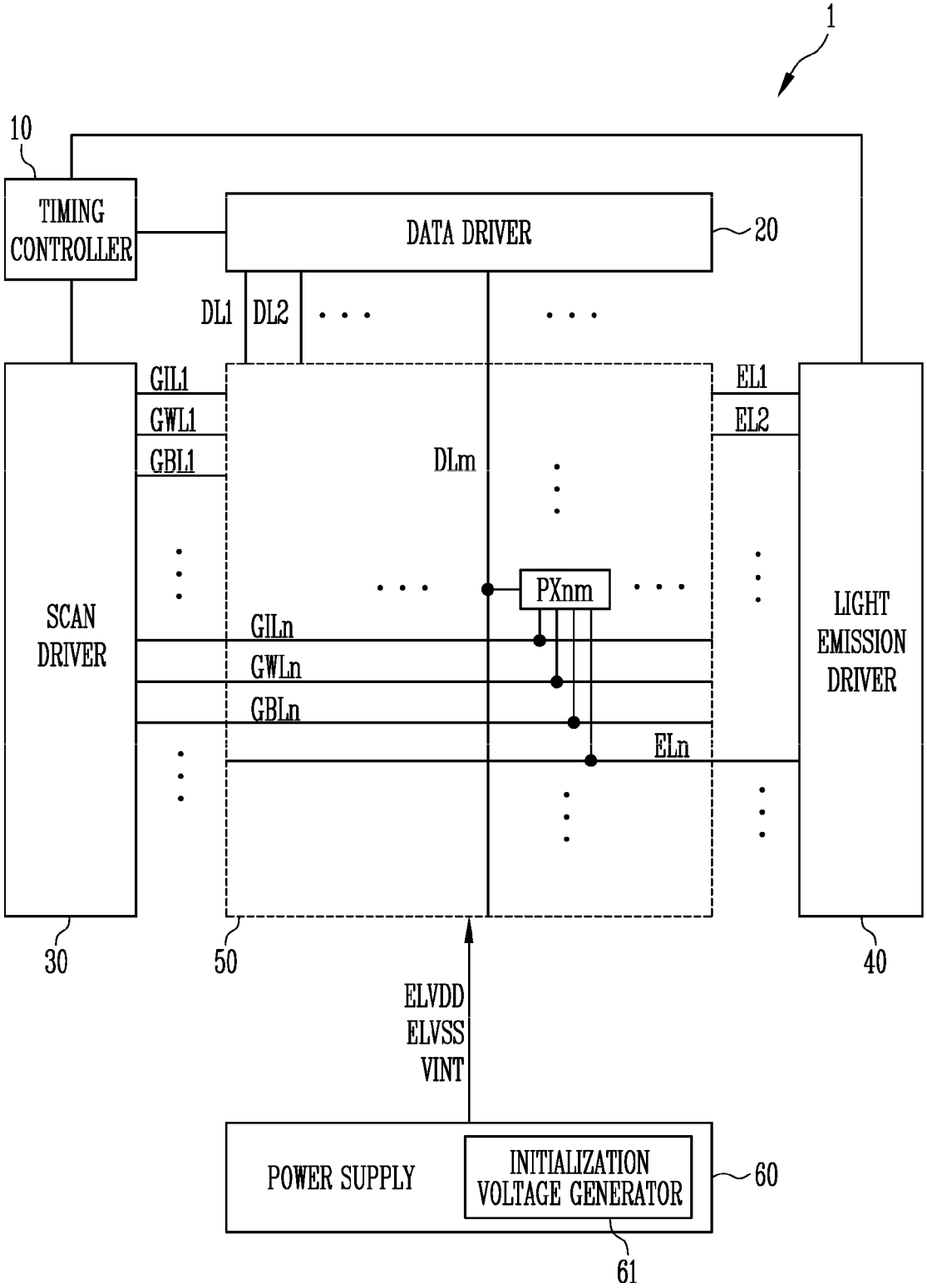
FIG. 2 is a block diagram schematically illustrating the display device according to an embodiment.
Figure 3:
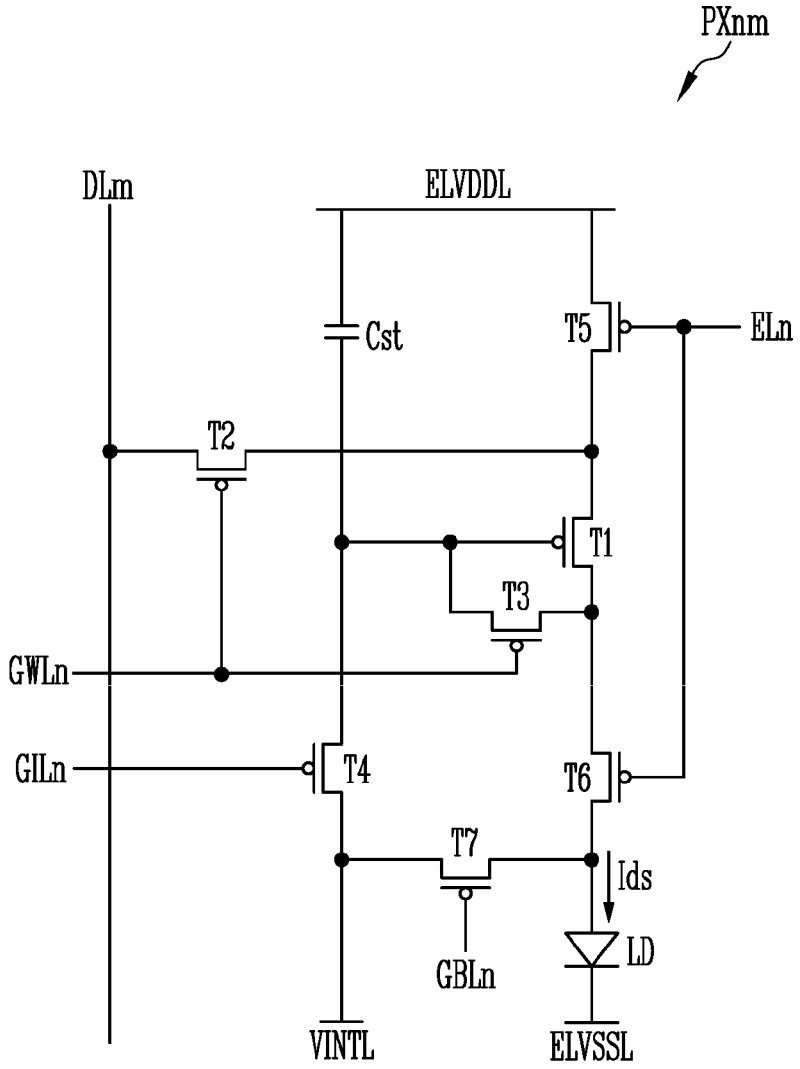
FIG. 3 is an equivalent circuit diagram of one pixel in the display device of FIG. 2 according to an embodiment.

FIG. 2 is a block diagram schematically illustrating the display device according to an embodiment. FIG. 3 is an equivalent circuit diagram of one pixel in the display device of FIG. 2 according to an embodiment.

Referring to FIG. 2, the display device 1 includes a timing controller 10, a data driver 20, a scan driver 30, a light emission driver 40, a display unit 50, and a power supply 60.

The timing controller 10 may generate signals necessary for the display device 1 according to an external input signal for an image frame received from an external processor/component. For example, the timing controller 10 may provide grayscale values and control signals to the data driver 20. The timing controller 10 may provide a clock signal, a scan start signal, and the like to the scan driver 30. The timing controller 10 may provide a clock signal, a light emission stop signal, and the like to the light emission driver 40.

The data driver 20 may generate data voltages to be provided to data lines DLm (including data lines DL1 and DL2) using the grayscale values and the control signals received from the timing controller 10. The data driver 20 may sample the grayscale values using a clock signal, and may apply the data voltages corresponding to the grayscale values to the data lines DLm (including data lines DL1 and DL2). Here, m may be a natural number.

The scan driver 30 may receive the clock signal, the scan start signal, and the like from the timing controller 10 to generate scan signals to be provided to scan lines GILn, GWLn, and GBLn (including scan lines GIL1, GWL1, and GBL1). Here, n may be a natural number.

Although not shown, the scan driver 30 may include a plurality of subset scan drivers. For example, a first subset scan driver may provide scan signals for first scan lines GILn, a second subset scan driver may provide scan signals for second scan lines GWLn, and a third subset scan driver may provide scan signals for third scan lines GBLn. Each of the subset scan drivers may include a plurality of scan stages connected in a form of a shift register. The scan signals may include a pulse of a turn-on level of the scan start signal that is sequentially transferred to a next scan stage.

The light emission driver 40 may receive the clock signal, the light emission stop signal, and the like from the timing controller 10 to generate light emission signals to be provided to light emission lines ELn (including light emission lines EL1 and EL2). The light emission driver 40 may sequentially provide light emission signals having pulses of a turn-off or turn-on level to the light emission lines ELn. The light emission driver 40 may be a shift register, and the light emission signals may include a pulse of a turn-off level of the light emission stop signal that is sequentially transferred to a next light emission stage under control of the clock signal.

The display unit 50 includes pixels PXnm. A pixel PXnm may be connected to one corresponding data line DLm, a plurality of scan lines GILn, GWLn, and GBLn, and one light emission line ELn. The numbers of data lines, scan lines, and light emission lines corresponding to the pixel PXnm may be configured according to embodiments.

The plurality of pixels PXnm may define a light emitting area that emits light of a plurality of colors. For example, the plurality of pixels PXnm may define a light emitting area that emits light of red, green, and blue. A pixel PXnm includes a plurality of transistors and at least one capacitor. In a pixel PXnm, at least one of the transistors may be a double gate transistor having two gate electrodes.

The display area DA (refer to FIG. 1) may include the light emitting area.

The power supply 60 may receive an external input voltage and provide a power voltage to an output terminal after converting the external input voltage. The power supply 60 generates a high power voltage ELVDD and a low power voltage ELVSS based on the external input voltage. The high power voltage ELVDD and low power voltage ELVSS may have unequal voltage levels. The power supply 60 may provide an initialization voltage VINT for initializing a gate electrode of the driving transistor and/or an anode of a light emitting diode LD (refer to FIG. 3) for each pixel PXnm.

The power supply 60 may receive an external input voltage from a battery or the like and may boost the external input voltage to generate a power voltage that is higher than the external input voltage. The power supply 60 may be a power management integrated chip (PMIC). The power supply 60 may be an external DC/DC IC.

The power supply 60 may include an initialization voltage generator 61. The initialization voltage generator 61 may control a voltage level of the initialization voltage VINT provided for each pixel PXnm. The initialization voltage VINT may have different voltage levels rather than a constant voltage level. The initialization voltage VINT described in the following description may be controlled by the initialization voltage generator 61.

Referring to FIG. 3, the pixel PXnm includes a plurality of transistors T1, T2, T3, T4, T5, T6, and T7, one storage capacitor Cst, and one light emitting diode LD.

In the first transistor T1, a first electrode may be connected to a first electrode of the second transistor T2, a second electrode may be connected to a first electrode of the third transistor T3, and a gate electrode may be connected to a second electrode of the third transistor T3. The first transistor T1 may also be referred to as a driving transistor. One of the first electrode and the second electrode of a transistor may be a source electrode of the transistor, and the other may be a drain electrode of the transistor.

In the second transistor T2, the first electrode may be connected to the first electrode of the transistor T1, a second electrode may be connected to the data line DLm, and a gate electrode may be connected to the second scan line GWLn. The second transistor T2 may be referred to as a scan transistor.

In the third transistor T3, the first electrode may be connected to the second electrode of the first transistor T1, the second electrode may be connected to the gate electrode of the first transistor T1, and a gate electrode may be connected to the second scan line GWLn. The third transistor T3 may be referred to as a diode connection transistor.

In the fourth transistor T4, a first electrode may be connected to a second electrode of the storage capacitor Cst, a second electrode may be connected to an initialization line VINTL, and a gate electrode may be connected to the first scan line GILn. The fourth transistor T4 may be referred to as a gate initialization transistor.

In the fifth transistor T5, a first electrode may be connected to the high power line ELVDDL, a second electrode may be connected to the first electrode of the first transistor T1, and a gate electrode may be connected to the light emission line ELn. The fifth transistor T5 may be referred to as a first light emission transistor.

In the sixth transistor T6, a first electrode may be connected to the second electrode of the first transistor T1, a second electrode may be connected to the anode of the light emitting diode LD, and a gate electrode may be connected to the light emission line ELn. The sixth transistor T6 may be referred to as a second light emission transistor.

In the seventh transistor T7, a first electrode may be connected to the anode of the light emitting diode LD, a second electrode may be connected to the initialization line VINTL, and a gate electrode may be connected to the third scan line GBLn. The seventh transistor T7 may be referred to as an anode initialization transistor.

In the storage capacitor Cst, a first electrode may be connected to the high power line ELVDDL, and the second electrode may be connected to the gate electrode of the first transistor T1.

In the light emitting diode LD, the anode may be connected to the second electrode of the sixth transistor T6, and a cathode may be connected to the low power line ELVSSL. A voltage applied to the low power line ELVSSL may be set to be lower than a voltage applied to the high power line ELVDDL. The light emitting diode LD may be an organic light emitting diode, an inorganic light emitting diode, a quantum dot light emitting diode, or the like.

A light emission amount of the light emitting diode LD may be determined by a current level of a driving current Ids supplied from the high power line ELVDDL. The driving current Ids may be a drain-source current Ids of the first transistor T1. The current level of the driving current Ids may be directly affected by transistors connected between the high power line ELVDDL and the low power line ELVSSL. For example, the transistors connected between the high power line ELVDDL and the low power line ELVSSL may include the first transistor T1, the fifth transistor T5, and the sixth transistor T6. Since the driving current Ids and the drain-source current Ids of the first transistor T1 are substantially the same current, the same reference numerals are used.

Each of the transistors T1 to T7 may be a P-type (PMOS) transistor. Channels of the transistors T1 to T7 may each include polysilicon. A polysilicon transistor may be a low temperature polysilicon (LTPS) transistor. The polysilicon transistor has high electron mobility and thus the polysilicon transistor has a fast driving characteristic.

The transistors T1 to T7 may be N-type (NMOS) transistors. The channels of the transistors T1 to T7 may each include an oxide semiconductor. Oxide semiconductor transistors are capable of low temperature processing and have low charge mobility compared to polysilicon. Therefore, an amount of leakage current generated in a turn-off state of the oxide semiconductor transistor is smaller than that of the polysilicon transistors.

Some of the transistors (for example, T1, T2, T5, T6, and T7) may be P-type transistors, and the remaining transistors (for example, T3 and T4) may be N-type transistors.

When the second transistor T2 is turned on and the data signal is supplied, the third transistor T3 is also turned on and thus the gate electrode and the second electrode of the first transistor T1 are electrically connected to each other. Therefore, the gate electrode and the second electrode of the first transistor T1 have substantially the same potential. When a voltage difference (a gate-source voltage difference, Vgs) between the gate electrode and the first electrode of the first transistor T1 is greater than a threshold voltage, the first transistor T1 forms a current path until the voltage difference between the gate electrode and the first electrode of the first transistor T1 reaches the threshold voltage of the transistor T1. Therefore, a voltage of the gate electrode and the second electrode is charged. That is, when the data signal is supplied to the first electrode of the first transistor T1, the voltage of the gate electrode and the second electrode of the first transistor T1 increase to a difference voltage between the data signal and the threshold voltage. Therefore, the first transistor T1 may be diode connected, and the threshold voltage may be compensated. This may be performed in a step of 'providing a data signal and compensating for the threshold voltage,'

Figure 4:
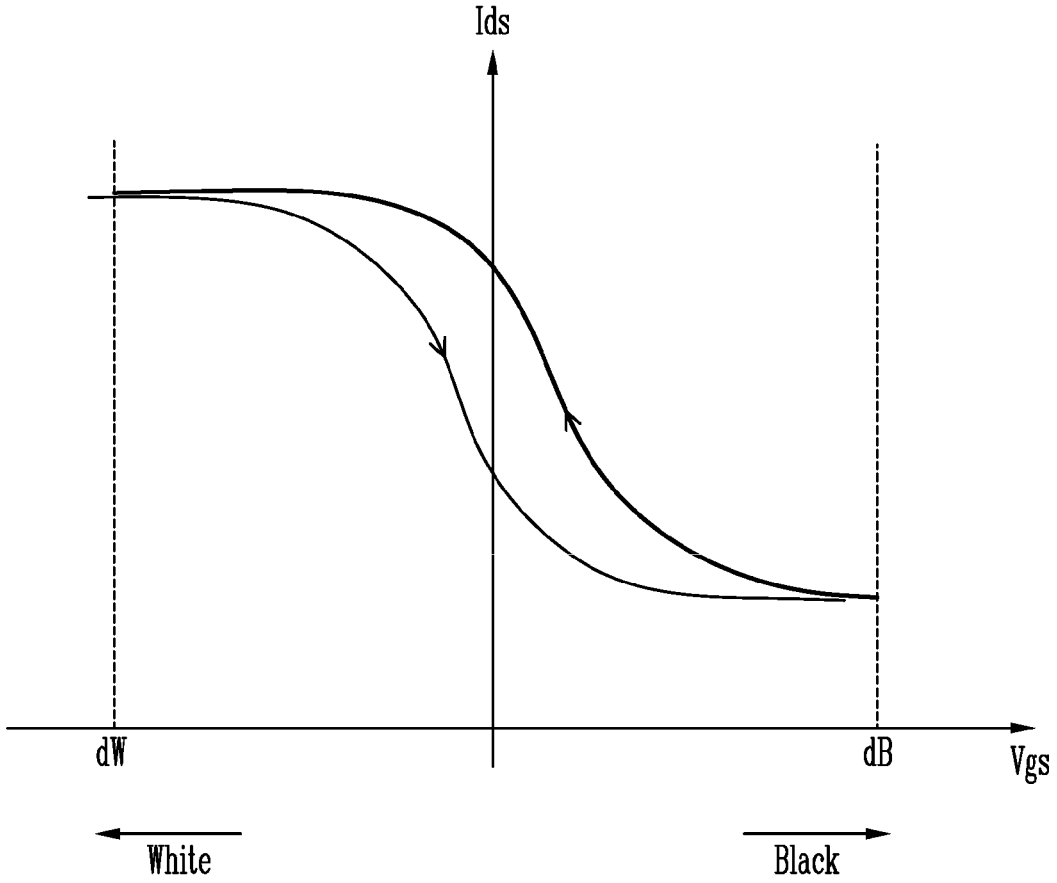
FIG. 4 is a graph illustrating a drain-source current of a driving transistor according to a gate-source voltage difference of the driving transistor in a gate on bias state and a gate off bias state in the display device according to an embodiment.
Figure 5:
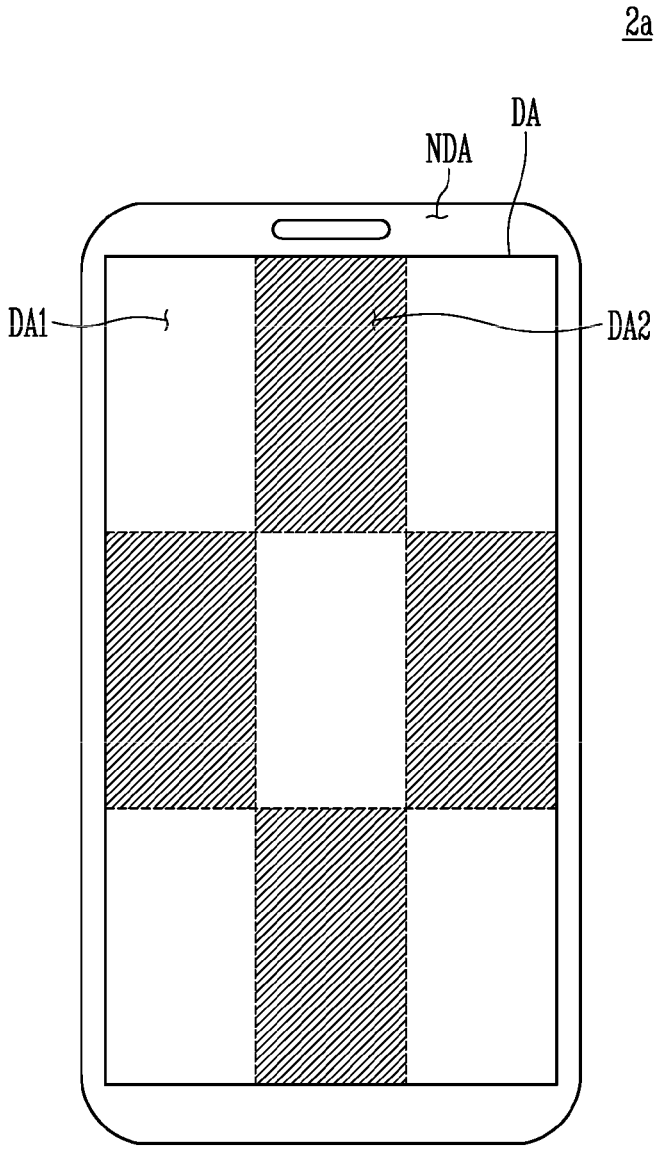
FIG. 5, FIG. 6, and FIG. 7 are plan views of a display device illustrating an example of a hysteresis phenomenon as a comparative example according to one or more embodiments.
Figure 6:
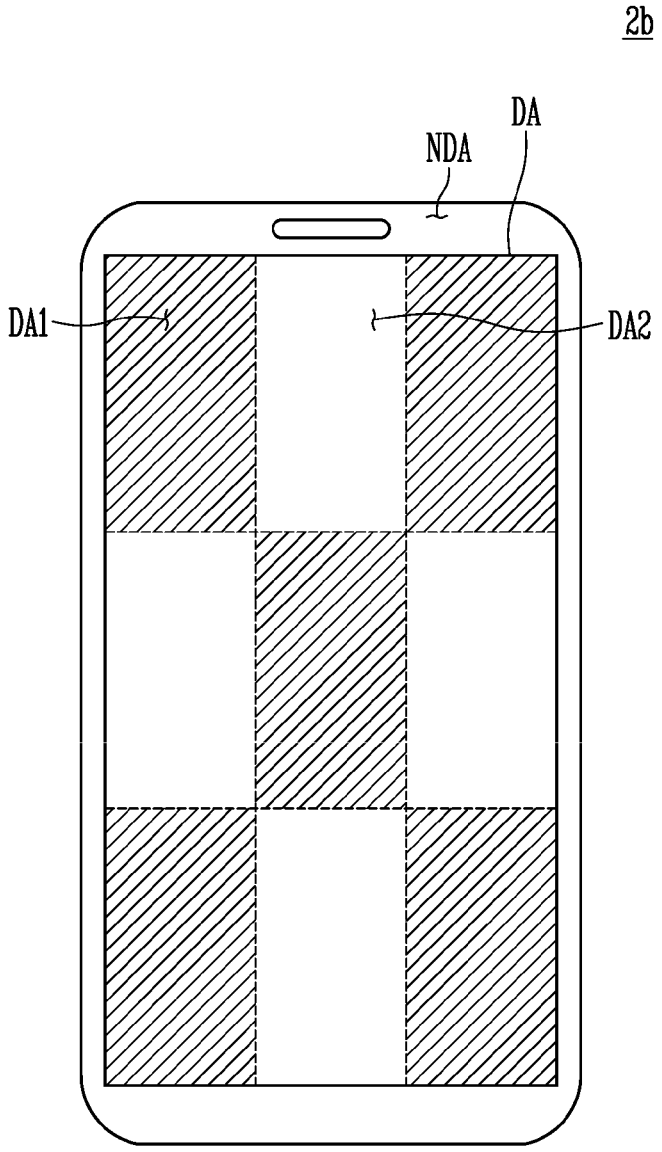
Figure 7:
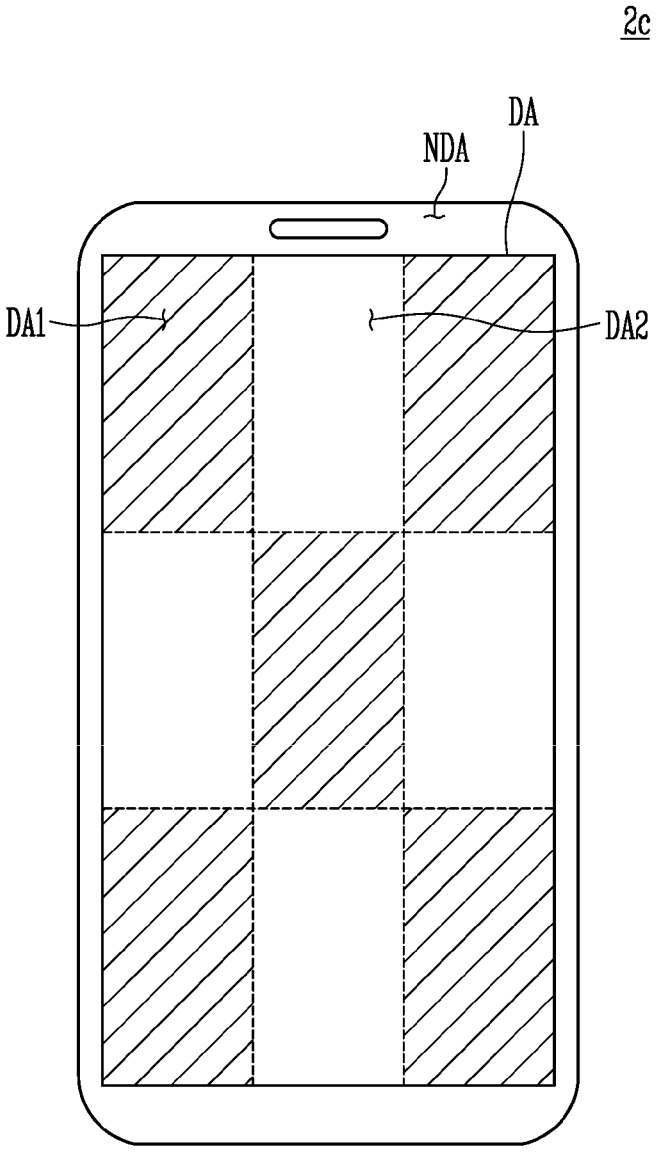

FIG. 4 is a graph illustrating a drain-source current of a driving transistor according to a gate-source voltage difference of the driving transistor in a gate on bias state and a gate off bias state in the display device according to an embodiment. FIGS. 5 to 7 are plan views of the display device illustrating an example of a hysteresis phenomenon as a comparative example according to one or more embodiments.

In an on bias state, a peak white grayscale voltage dW is applied to the gate electrode of the first/driving transistor T1, and thus the drain-source current Ids of the first transistor T1 significantly flows. In an off bias state, a peak black grayscale voltage dB is applied to the gate electrode of the first/driving transistor T1, and thus the drain-source current Ids of the first transistor T1 hardly flows. The peak white grayscale voltage dW is applied to the gate electrode of the first transistor T1 to emit light at a peak white grayscale, and the peak black grayscale voltage dB is applied to the gate electrode of the first transistor T1 to emit light at a peak black grayscale. For example, when a grayscale value is expressed as an 8 bit digital value, the peak black grayscale may be "0" (which is a minimum value), and the peak white grayscale may be "255" (which is a maximum value).

Referring to FIG. 4, for the P-type first transistor T1, a curve corresponding to amounts of the drain-source current Ids from the on bias state to the off bias state is different from a curve corresponding to amounts of the drain-source current Ids from the off bias state to the off bias state. A significant difference of the drain-source current Ids of the first transistor T1 may occur in the same grayscale.

The difference is referred to as a hysteresis phenomenon, and the hysteresis phenomenon may be a cause of an afterimage.

The difference between the drain-source current Ids values may not stabilize a driving characteristic of the light emitting diode that is driven based on the driving current Ids and may cause a luminance difference when a P-type transistor is used as a driving thin film transistor of an organic light emitting diode display.

FIGS. 5 to 7 illustrate states 2*a*, 2*b*, and 2*c* of a display device in response to a constant DC initialization voltage VINT.

Referring to FIG. 5, in the state 2*a* of the display device, the display area DA of the display device may include a plurality of first subset display areas DA1 including pixels to which the peak white grayscale voltage dW is applied for a specific time (for example, two hours) and may include a plurality of second subset display areas DA2 including pixels to which the peak black grayscale voltage dB is applied. The first subset display areas DA1 and the second subset display areas DA2 may be alternately disposed in a matrix form.

Referring to FIG. 6, when the peak white grayscale voltage dW is applied to the pixels in the entire display area DA after the specific time has elapsed, in the state 2*b* of the display device, the luminance of the first subset display areas DA1 of the display device may be lower than the luminance of the second subset display areas DA2. An unwanted chess pattern may be formed in the display area DA.

As time passes, referring to FIG. 7, in the state 2*c* of the display device, the luminance of the first subset display area DA1 of the display device may become similar to the luminance of the second subset display area DA2.

Such a phenomenon may be recognized by the user of the display device as an instant afterimage. The instant afterimage phenomenon may be caused by the hysteresis phenomenon of the driving transistor.

Figure 8:
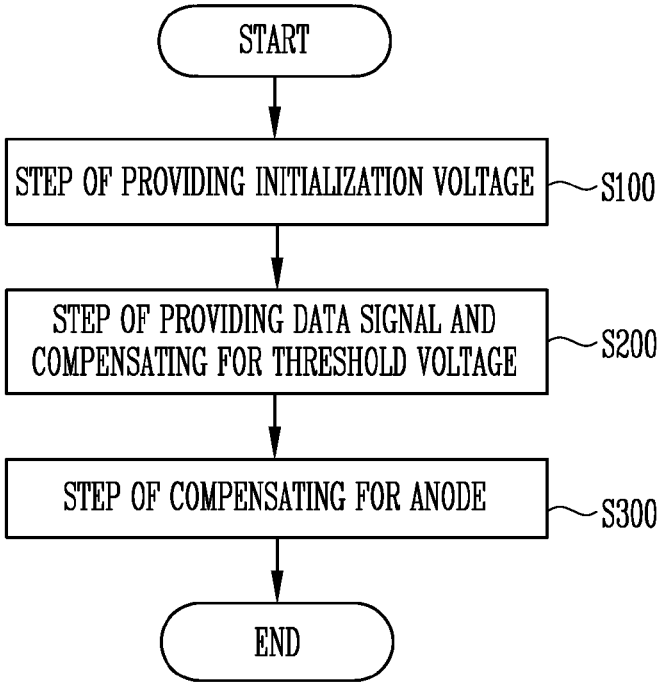
FIG. 8 is a flowchart illustrating a method of driving a display device according to an embodiment.
Figure 9:
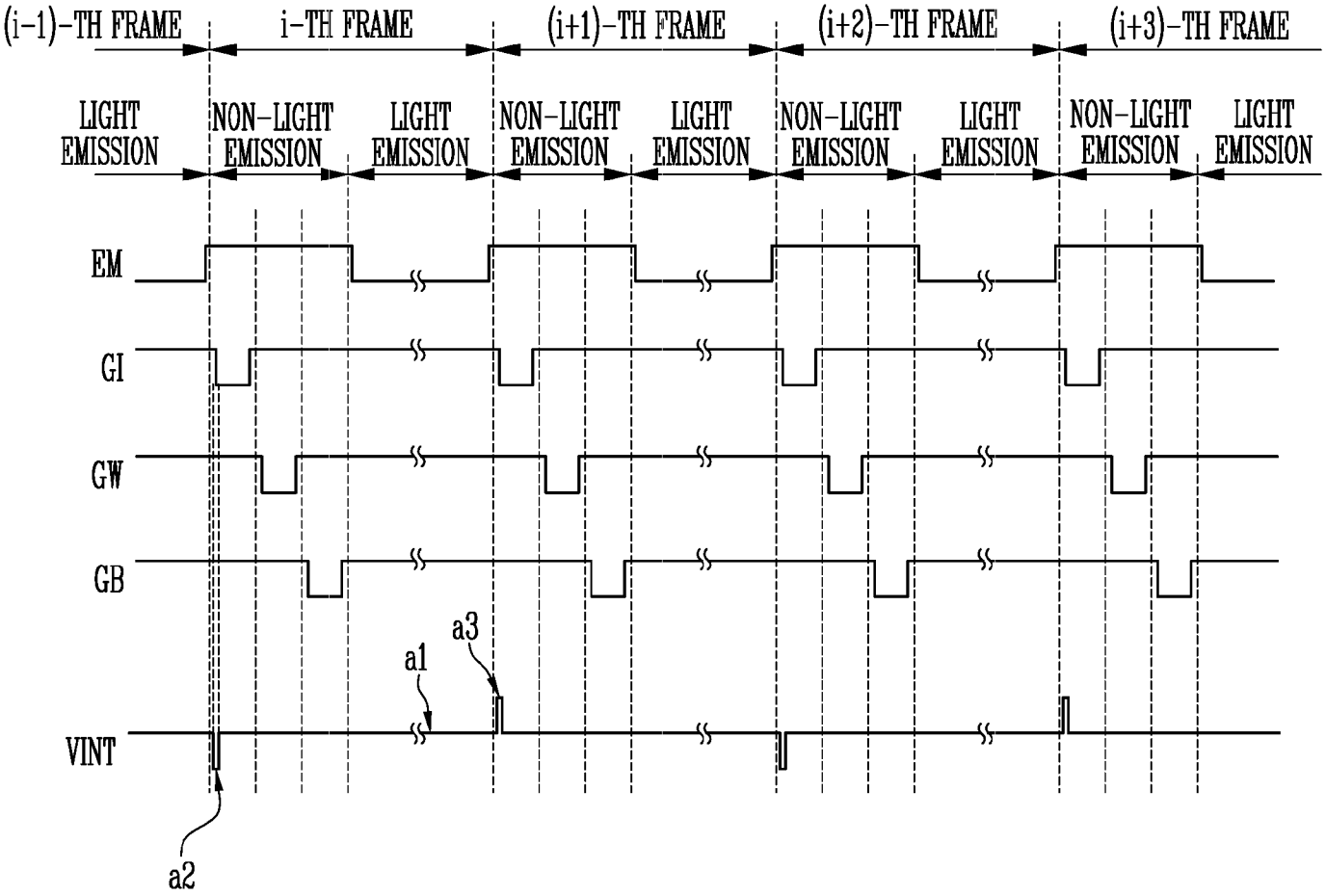
FIG. 9 is a timing diagram illustrating a method of driving a display device according to an embodiment.

FIG. 8 is a flowchart illustrating a method of driving a pixel of a display device illustrated in FIGS. 2 and 3 according to an embodiment. FIG. 9 is a timing diagram illustrating a method of driving a display device according to an embodiment.

Hereinafter, each of the transistors T1 to T7 in the pixel is a P-type transistor, is turned on in response to a predetermined low logic level signal (turn-on signal) applied to the corresponding gate electrode, and is turned off in response to a predetermined high logic level signal (turn-off signal).

Referring to FIGS. 8 and 9, the pixel may receive a light emission control signal EM of a high logic level to maintain a non-light emission (turn-off) state of the light emitting diode LD, and may receive a light emission control signal EM of a low logic level to maintain a light emission (turn-on) state of the light emitting diode LD.

Corresponding to frame periods, light emission control signal EM provided to each pixel may alternate between the high logic level and the low logic level. A period in which the light emission control signal EM of the high logic level is provided to the pixel may be a data writing period, and a period in which the light emission control signal EM of the low logic level is provided to the pixel may be a light emission period.

In the non-light emission (turn-off) state of the light emitting diode LD in one frame period, a compensation mechanism for compensating for the threshold voltage of the driving transistor may be provided to each pixel so that the light emitting diode LD has a target luminance when the light emitting diode LD becomes the light emission (turn-on) state in a next frame period. FIG. 9 shows a timing diagram for the compensation mechanism in an i-th frame period, an (i+1)-th frame period, an (i+2)-th frame period, and an (i+3)-th frame period, which represent four successive frame periods.

The method may include steps S100, S200, and S300 and may be performed when the non-light emission (turn-off) state of the light emitting diode LD is maintained. In a 'step of providing an initialization voltage (S100),' a first scan signal GI of a low logic level (i.e., a first turn-on scan signal) is supplied to each pixel through the first scan lines GILn. In a 'step of providing a data signal and compensating for a threshold voltage (S200),' a second scan signal GW of a low logic level (i.e., a second turn-on scan signal) is supplied through the second scan lines GWLn. In a 'step of compensating for an anode (S300),' a third scan signal GB of a low logic level (i.e., a third turn-on scan signal) is supplied through the third scan lines GBLn. The steps S100, S200, S300 may be sequentially started (and/or sequentially performed).

Referring to FIG. 8 and FIG. 9, the steps are sequentially performed. In embodiments, some steps may be performed simultaneously, an order of each step may be changed, some steps may be optional, or other steps may be further included. In embodiments, the 'step of providing an initialization voltage (S100)', the 'step of providing a data signal and compensating for a threshold voltage (S200)', and the 'step of compensating for an anode (S300)' do not overlap in time. In embodiments, two or more steps may partially overlap in time.

In the 'step of providing an initialization voltage (S100)', the fourth transistor T4 is turned on, and the gate electrode of the first transistor T1 is connected to the initialization line VINTL. Therefore, a voltage of the gate electrode of the first transistor T1 is initialized to the initialization voltage VINT of the initialization line VINTL and maintained by the storage capacitor Cst. The initialization voltage VINT of the initialization line VINTL may be a voltage sufficiently lower than the voltage of the high power line ELVDDL. The initialization voltage VINT may be a voltage of a level similar to that of the low power line ELVSSL.

The initialization voltage VINT may have a plurality of voltage levels. The method of driving the display device 1 may include a frame period in which the initialization voltage VINT having different voltage levels is supplied in the 'step of providing an initialization voltage (S100)'. The initialization voltage VINT may be in a range of about −10 V to about 2 V.

The initialization voltage VINT may have a first voltage level a1 equal to a reference voltage level, a second voltage level a2 lower than the first voltage level a1, and a third voltage level a3 higher than the first voltage level a1. The first voltage level a1 may be in a range of −5 V to −3 V, the second voltage level a2 may be in a range of −11 V to −9 V, and the third voltage level a3 may be in a range of 0 V to 2 V. For example, the first voltage level a1 is −4 V, the second voltage level a2 is −9 V, and the third voltage level a3 is 1 V.

The initialization voltage VINT may be set to initialize the voltage of the gate electrode of the first transistor T1 to the first voltage level a1. Before supply of the first scan signal GI of the low logic level is ended in the 'step of providing an initialization voltage (S100)', the initialization voltage VINT may be offset/adjusted/changed to a specific voltage such as the second voltage level a2 or the third voltage level a3. A period in which the first scan signal GI of the low logic level is supplied in the 'step of providing an initialization voltage (S100)' of each frame period may include a period in which the initialization voltage VINT of the first voltage level a1 is supplied, and a period in which the initialization voltage VINT offset from the first voltage level a1 is supplied. The initialization voltage VINT may have the first voltage level a1 immediately before the supply of the first scan signal GI of the low logic level is ended.

Offset/adjustment directions of the initialization voltage VINT may not be the same for two consecutive frame periods. In a first frame period, the offset direction of the initialization voltage VINT may be a positive voltage level direction from the first voltage level a1; in a second frame period immediately following the first frame period, the offset direction may be a negative voltage level direction from the first voltage level a1. In a frame period, the initialization voltage VINT is offset from the first voltage level a1 to the second voltage level a2 in a negative direction; in the immediately following frame period, the initialization voltage VINT is offset from the first voltage level a1 to the third voltage level a3 in a positive direction.

The offset degree (absolute value) in different frame periods may be the same. For example, a degree at which the first voltage level a1 (for example, −4 V) is offset to the second voltage level a2 (for example, −9 V) in the 'step of providing an initialization voltage (S100)' of the i-th frame period may be 5 V, and a degree at which the first voltage level a1 (for example, −4 V) is offset to the third voltage level a3 (for example, 1 V) in the 'step of providing an initialization voltage (S100)' of the (i+1)-th frame period may be 5 V.

The initialization voltage VINT may be offset to the second voltage level a2 and then maintained at the first voltage level a1 in the 'step of providing an initialization voltage S100' of the i-th frame period, and the initialization voltage VINT may be offset to the third voltage level a3 and then maintained at the first voltage level a1 in the 'step of providing an initialization voltage S100' of the (i+1)-th frame period.

The offset directions may alternate for frame periods. The initialization voltage VINT is offset to the second voltage level a2 in the 'step of providing an initialization voltage (S100)' of the i-th frame period, the initialization voltage VINT is offset to the third voltage level a3 in the 'step of providing an initialization voltage (S100)' of the (i+1)-th frame period, the initialization voltage VINT is offset to the second voltage level a2 in the 'step of providing an initialization voltage (S100)' of the (i+2)-th frame period, and the initialization voltage VINT is offset to the third voltage level a3 in the 'step of providing an initialization voltage (S100)' of the (i+3)-th frame period.

The supply of the first scan signal GI of the low logic level may be started when the offset value of the initialization voltage VINT is maintained. For example, during the i-th frame period, in the 'step of providing an initialization voltage (S100)', the initialization voltage VINT may be offset from the first voltage level a1 to the second voltage level a2 immediately before the supply of the first scan signal GI of the low logic level is started, and the initialization voltage VINT may be returned to and maintained at the first voltage level a1 after the supply of the first scan signal GI of the low logic level is started.

Before the supply of the first scan signal GI of the low logic level is ended, the initialization voltage VINT may be offset to minimize the afterimage caused by the hysteresis phenomenon. In embodiments, stress of the driving transistor may be reduced by alternating the offset directions for frame periods.

In the 'step of providing a data signal and compensating for a threshold voltage (S200)', the second scan signal GW of the low logic level (turn-on level) is supplied to the second scan line GWLn, and the second transistor T2 and the third transistor T3 are turned on. Therefore, the data voltage applied to the data line DLm is written to the storage capacitor Cst through the second transistor T2, the first transistor T1, and the third transistor T3. However, the data voltage at this time is a data voltage of a previous-previous pixel, and is for applying an on-bias voltage to the first transistor T1, not for emitting light of the pixel PXnm. Since the on-bias voltage is applied to the first transistor T1 before an actual data voltage is written, the hysteresis phenomenon may be mitigated. At this time, the data voltage written to the storage capacitor Cst may be a voltage in which a decrease of the threshold voltage of the transistor T1 is compensated for.

In the 'step of compensating for an anode (S300)', the third scan signal GB of the low logic level (turn-on level) is supplied to the third scan line GBLn, and the seventh transistor T7 is turned on. Therefore, a voltage of the anode of the light emitting diode LD is initialized.

In the 'step of compensating for an anode (S300)', the initialization voltage VINT may maintain at a constant voltage level. During a period in which the third scan signal GB of the low logic level is supplied through the third scan lines GBLn, the initialization voltage VINT may maintain the first voltage level a1. The period in which the initialization voltage VINT is offset from the first voltage level a1 may not overlap the period in which the third scan signal GB of the low logic level is supplied through the third scan lines GBLn. Therefore, an anode voltage of the light emitting diode LD may be initialized to the first voltage level a1.

After the step S300, the display device 1 may be in a light emission period, in which the pixel receives the light emission control signal EM of the low logic level.

When the light emission signal EM becomes the low logic level (turn-on level), the fifth transistor T5 and the sixth transistor T6 are turned on. Therefore, the driving current Ids may flow from the high power line ELVDDL through the fifth transistor T5, the first transistor T1, the sixth transistor T6, and the light emitting diode LD to the low power line ELVSSL. An amount of the driving current Ids corresponds to the data voltage stored in the storage capacitor Cst. Since the driving current Ids flows through the first transistor T1, the decrease of the threshold voltage of the first transistor T1 may affect the driving current Ids. Since the effect of the decrease of the threshold voltage on the data voltage stored in the storage capacitor Cst and the effect of the decrease of the threshold voltage on the driving current Ids cancel each other, the driving current Ids corresponding the data voltage may flow regardless of the threshold voltage value of the transistor T1.

According to the amount of the driving current Ids, the light emitting diode LD emits light at a desired luminance. The afterimage caused by the hysteresis phenomenon may be minimized and may not be perceived by the user.

Figure 10:
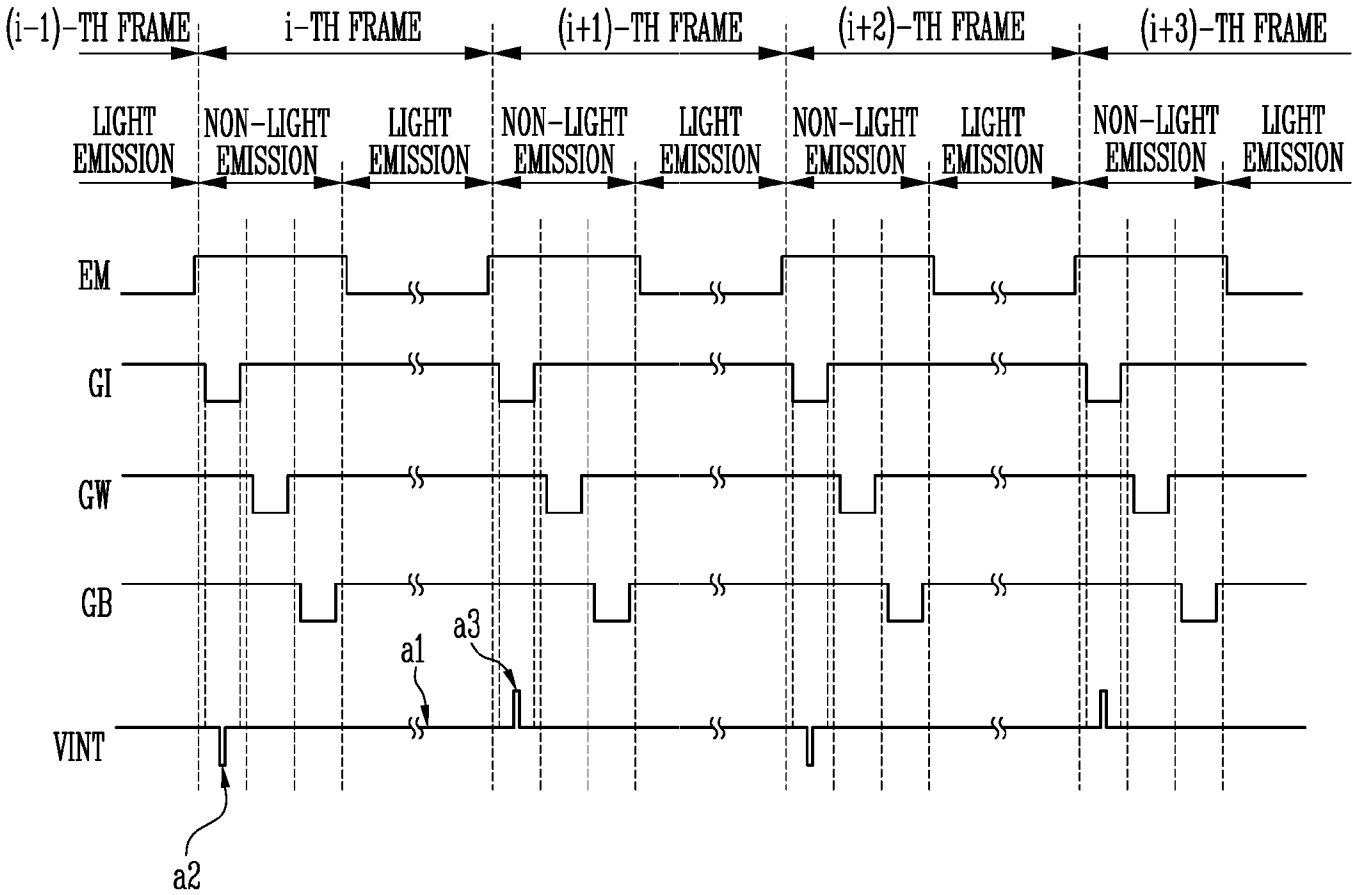
FIG. 10 is a timing diagram illustrating a method of driving a display device according to an embodiment.

FIG. 10 is a timing diagram illustrating a method of driving a display device according to an embodiment.

Referring to FIG. 10, the initialization voltage VINT of the first voltage level a1 is offset to the second voltage level a2 or the third voltage level a3 when the supply of the first scan signal GI of the low logic level (turn-on level) is maintained for each frame period, in comparison with the embodiment of FIG. 9.

In the 'step of providing an initialization voltage' of the i-th frame period, the initialization voltage VINT of the first voltage level a1 may be offset to the second voltage level a2 after the first scan signal GI of the low logic level is supplied, and the initialization voltage VINT may return to the first voltage level a1 before the supply of the first scan signal GI of the low logic level is ended.

In the 'step of providing an initialization voltage' of the (i+1)-th frame period, the initialization voltage VINT of the first voltage level a1 may be offset to the third voltage level a3 after the first scan signal GI of the low logic level is supplied, and the initialization voltage VINT may return to the first voltage level a1 before the supply of the first scan signal GI of the low logic level is ended.

Figure 11:
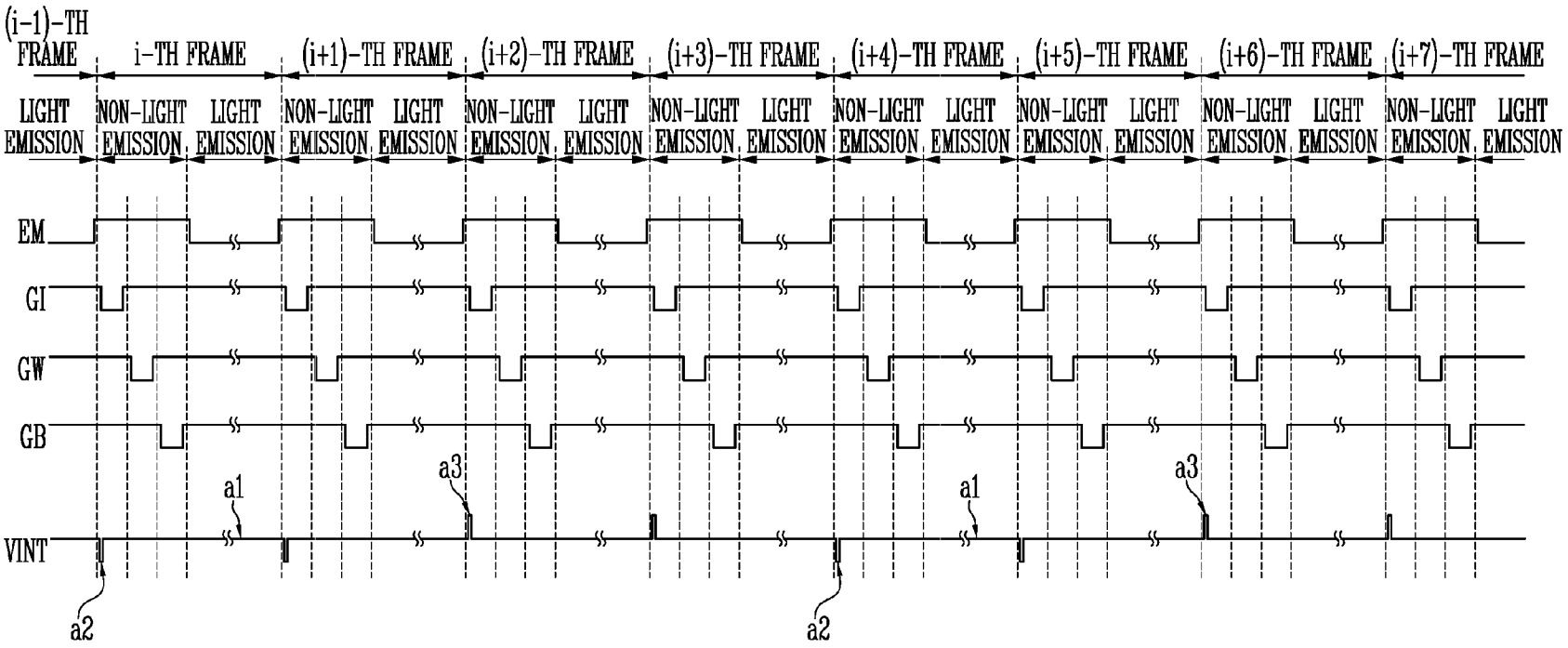
FIG. 11 is a timing diagram illustrating a method of driving a display device according to an embodiment.

FIG. 11 is a timing diagram illustrating a method of driving a display device according to an embodiment.

Referring to FIG. 11, frame periods (e.g., two frame periods) in which the initialization voltage VINT is offset to the second voltage level a2 in the 'step of providing an initialization voltage' may be successive, and frame periods (e.g., two frame periods) in which the initialization voltage VINT is offset to the third voltage level a3 may be successive.

In the 'step of providing an initialization voltage', the initialization voltage VINT is offset to the second voltage level a2 in at least two successive frame periods, and the initialization voltage VINT is offset to the third voltage level a3 in at least two successive frame periods.

The initialization voltage VINT may be offset to the second voltage level a2 in the 'step of providing an initialization voltage' of an i-th frame period, the initialization voltage VINT may be offset to the second voltage level a2 in the 'step of providing an initialization voltage' of an (i+1)-th frame period, the initialization voltage VINT may be offset to the third voltage level a3 in the 'step of providing an initialization voltage' of an (i+2)-th frame period, the initialization voltage VINT may be offset to the third voltage level a3 in the 'step of providing an initialization voltage' of an (i+3)-th frame period, the initialization voltage VINT may be offset to the second voltage level a2 in the 'step of providing an initialization voltage' of an (i+4)-th frame period, the initialization voltage VINT may be offset to the second voltage level a2 in the 'step of providing an initialization voltage' of an (i+5)-th frame period, the initialization voltage VINT may be offset to the third voltage level a3 in the 'step of providing an initialization voltage' of an (i+6)-th frame period, and the initialization voltage VINT may be offset to the third voltage level a3 in the 'step of providing an initialization voltage' of an (i+7)-th frame period.

Figure 12:
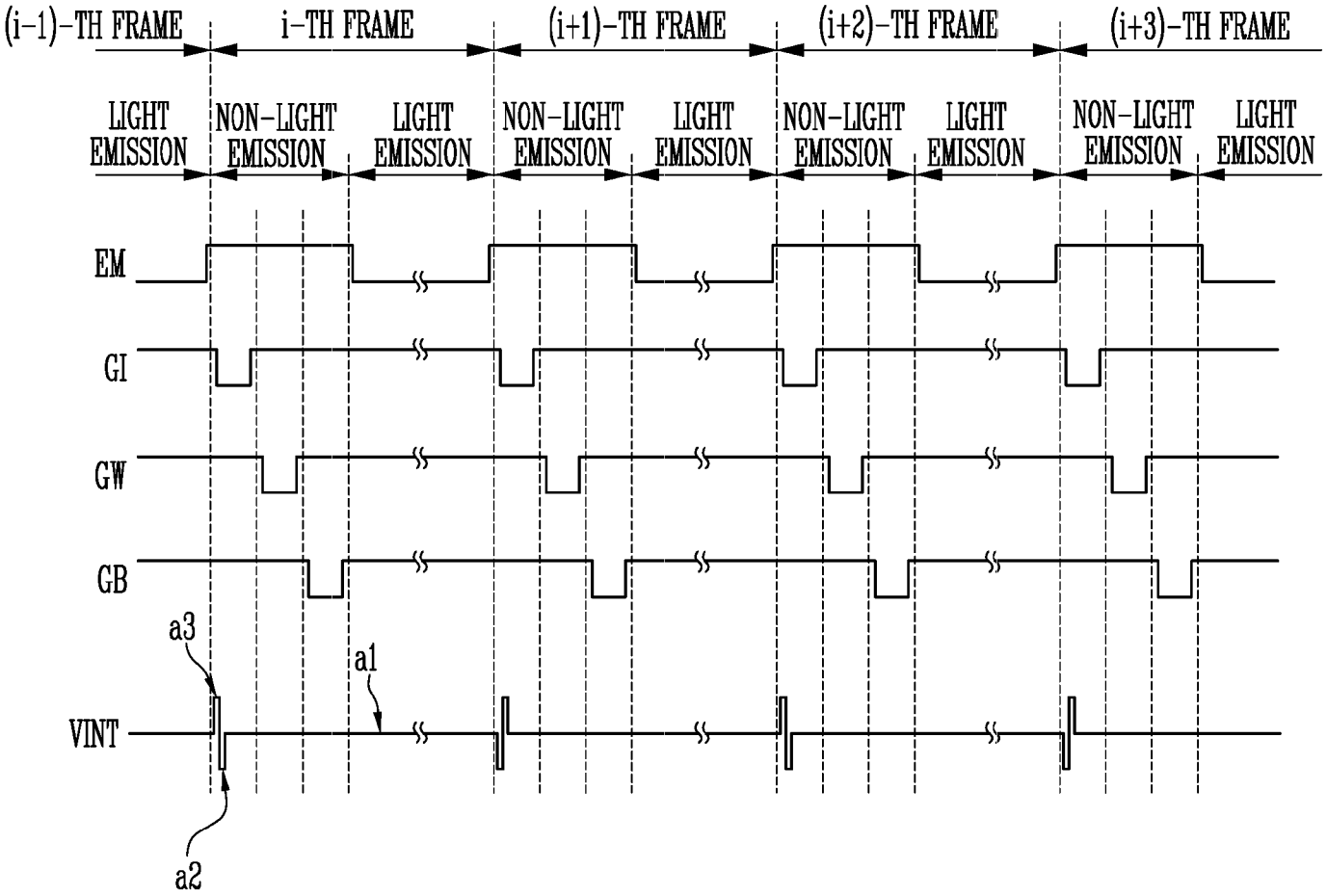
FIG. 12 is a timing diagram illustrating a method of driving a display device according to an embodiment.

FIG. 12 is a timing diagram illustrating a method of driving a display device according to an embodiment.

Referring to FIG. 12, the initialization voltage VINT is offset twice in different directions in the 'step of providing an initialization voltage' for each frame period.

For example, in the 'step of providing an initialization voltage (S100)' of the i-th frame period, the initialization voltage VINT may be changed from the first voltage level a1 to the third voltage level a3 immediately before the first turn-on scan signal GI is provided and then offset to the second voltage level a2 (when the first turn-on scan signal GI is provided).

In the 'step of providing an initialization voltage' of the (i+1)-th frame period, the initialization voltage VINT may be changed from the first voltage level a1 to the second voltage level a2 immediately before the first turn-on scan signal GI is provided and then offset to the third voltage level a3 (when the first turn-on scan signal GI is provided).

The initialization voltage VINT is offset twice in different directions in the 'step of providing an initialization voltage'. Therefore, offset stress applied to the driving transistor may be reduced while the hysteresis phenomenon is minimized.

Figure 13:
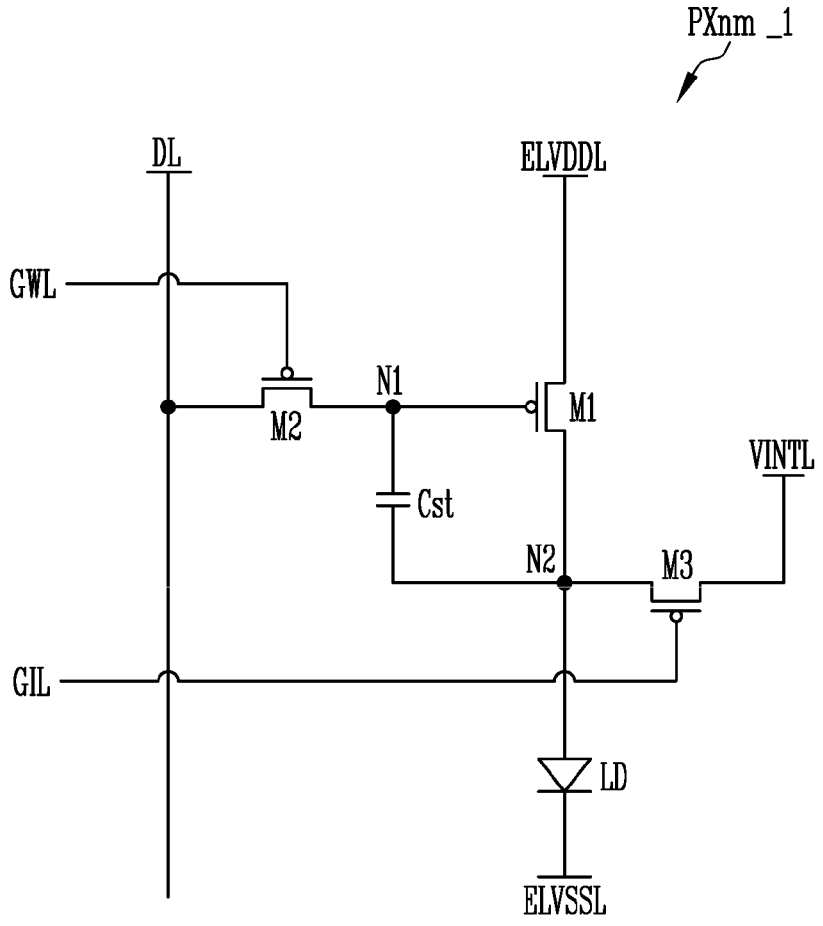
FIG. 13 is an equivalent circuit diagram of one pixel in a display device according to an embodiment.

FIG. 13 is an equivalent circuit diagram of one pixel in a display device according to an embodiment.

Referring to FIG. 13, the pixel may include a first transistor M1, a second transistor M2, a third transistor M3, a storage capacitor Cst, and a light emitting diode LD. The first transistor M1 may be a driving transistor. Parts of the timing diagrams described above may be applicable to the pixel illustrated in FIG. 13.

The second transistor M2 may supply the data voltage supplied through the data line DL to the first node N1 in response to the second scan signal GW supplied through the second scan line GWL.

The third transistor M3 may provide the initialization voltage VINT for initializing a second node N2 positioned between the driving transistor and the light emitting diode LD, in response to the first scan signal GI supplied through the first scan line GIL.

Figure 14:
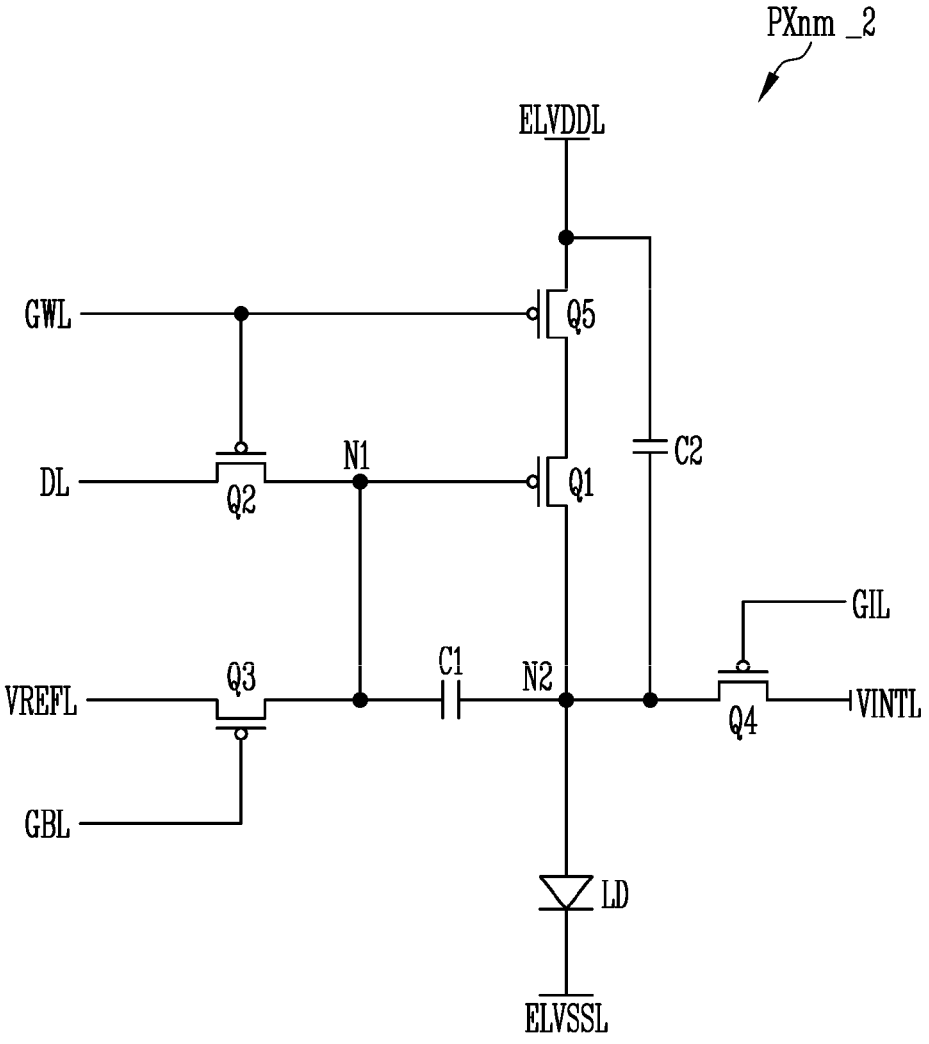
FIG. 14 is an equivalent circuit diagram of one pixel in a display device according to an embodiment.

FIG. 14 is an equivalent circuit diagram of one pixel in a display device according to an embodiment.

Referring to FIG. 14, the pixel may include a first transistor Q1, a second transistor Q2, a third transistor Q3, a fourth transistor Q4, a fifth transistor Q5, a first capacitor C1, a second capacitor C2, and a light emitting diode LD. In the present embodiment, the first transistor Q1 may be a driving transistor.

The first transistor Q1 may be positioned between the high power line ELVDDL and the second node N2 and may provide a driving current corresponding to the data voltage to the light emitting diode LD. The first transistor Q1 may include a gate electrode connected to the first node N1, a first electrode connected to a second electrode of the fifth transistor Q5, and a second electrode connected to the second node N2.

The second transistor Q2 may apply the data voltage received from the data line DL to the first node N1 in response to the second scan signal GW received from the second scan line GWL. The second transistor Q2 may include a gate electrode receiving the second scan signal GW, a first electrode receiving the data voltage, and a second electrode connected to the first node N1.

The third transistor Q3 may apply a reference voltage to the first node N1 in response to the third scan signal GB received from the third scan line GBL. The third transistor Q3 may include a gate electrode receiving the third scan signal GB, a first electrode connected to a reference voltage line VREFL, and a second electrode connected to the first node N1. The reference voltage may be supplied from the power supply 60 (refer to FIG. 2). The reference voltage may be set to a voltage higher than the data voltage of the peak white grayscale and may be set to a voltage lower than the data voltage of the peak black grayscale.

In an embodiment, the second transistor Q2 may receive the data voltage from the data line DL, and the third transistor Q3 may receive the reference voltage from the reference voltage line VREFL. The pixel may receive the reference voltage from the reference voltage line VREFL different from the data line DL. Therefore, a length of a period for compensating for the threshold voltage may not be limited to one horizontal period and may be freely adjusted.

The fourth transistor Q4 may apply the initialization voltage VINT to the second node N2 in response to the first scan signal GI received from the first scan line GIL. The fourth transistor Q4 may include a gate electrode receiving the first scan signal GI, a first electrode receiving the initialization voltage VINT, and a second electrode connected to the second node N2.

The fifth transistor Q5 may include a gate electrode connected to the second scan line GWL, a first electrode connected to the high power line ELVDDL, and the second electrode connected to the first electrode of the first transistor Q1.

The first capacitor C1 may be connected between the first node N1 and the second node N2. The first capacitor C1 may include a first electrode connected to the first node N1 and a second electrode connected to the second node N2.

The second capacitor C2 may be connected between the second node N2 and the high power EVLDD. The second capacitor C2 may include a first electrode connected to the second node N2 and a second electrode connected to the high power line ELVDDL.

The light emitting diode LD may include an anode connected to the second node N2 and a cathode connected to the low power line ELVSSL.

Although example embodiments have been described with reference to the accompanying drawings, practical embodiments may be implemented in other specific forms without departing from the scope defined in the claims.

What is claimed is:

1. A method of operating a display device, the method comprising:

in a first frame period, before changing a gate initialization transistor from on to off, changing an initialization voltage from a first voltage level to a second voltage level and subsequently returning the initialization voltage to the first voltage level, wherein the second voltage level is unequal to the first voltage level, wherein the display device comprises the gate initialization transistor and a driving transistor, wherein a first electrode the gate initialization transistor receives the initialization voltage, and wherein a second electrode of the gate initialization transistor is electrically connected to a gate electrode of the driving transistor; and in a second frame period, before changing the gate initialization transistor from on to off, changing the initialization voltage from the first voltage level to at least one of the second voltage level and a third voltage level and subsequently returning the initialization voltage to the first voltage level, wherein the third voltage level is unequal to each of the first voltage level and the second voltage level.

2. The method according to claim 1, comprising:

in the first frame period, after changing the gate initialization transistor from off to on, changing a scan transistor from off to on, wherein the display device comprises the scan transistor and a data line, and wherein a first electrode of the scan transistor is electrically connected to the data line; and in the first frame period, maintaining the initialization voltage at the first voltage level when the scan transistor is on.

3. The method according to claim 1, comprising:

in the first frame period, before changing the initialization voltage from the first voltage level to the second voltage level, changing the gate initialization transistor from off to on.

4. The method according to claim 1, comprising:

in the first frame period, after changing the initialization voltage from the first voltage level to the second voltage level, changing the gate initialization transistor from off to on.

5. The method according to claim 4, comprising:

in the first frame period, after changing the gate initialization transistor from off to on, changing the initialization voltage from the second voltage level to the first voltage level.

6. The method according to claim 1, wherein in the first frame period, the gate initialization transistor remains on for longer time than the initialization voltage remains at the second voltage level.

7. The method according to claim 1, wherein the at least one of the second voltage level and the third voltage level includes the third voltage level, wherein the second voltage level is lower than the first voltage level, and wherein the third voltage level is higher than the first voltage level.

8. The method according to claim 1, wherein the at least one of the second voltage level and the third voltage level is the third voltage level, and wherein the first frame period immediately precedes the second frame period.

9. The method according to claim 1, wherein the at least one of the second voltage level and the third voltage level includes the third voltage level, wherein a difference between the second voltage level and the first voltage level is equal to a difference between the third voltage level and the first voltage level.

10. The method according to claim 1, wherein the at least one of the second voltage level and the third voltage level includes the third voltage level, wherein the first voltage level is in a range of −5 V to −3 V, wherein the second voltage level is in a range of −11 V to −9 V, and wherein the third voltage level is in a range of 0 V to 2 V.

11. The method according to claim 1, wherein the first frame period immediately precedes the second frame period, and wherein the at least one of the second voltage level and the third voltage level is the second voltage level.

12. The method according to claim 1, comprising:

in the first frame period, changing the initialization voltage from the second voltage to the third voltage level and subsequently changing the initialization voltage from the third voltage level to the first voltage level; and in the second frame period, changing the initialization voltage from the third voltage level to the second voltage level and subsequently changing the initialization voltage from the second level to the first voltage level, wherein the second frame period immediately follows the first frame period.

13. The method according to claim 1, comprising:

in the first frame period, after changing the gate initialization transistor from off to on, changing an anode initialization transistor from off to on, wherein the display device comprises the anode initialization transistor and a light emitting diode, and wherein a first electrode of the anode initialization transistor is electrically connected to an anode of the light emitting diode.

14. The method according to claim 13, comprising:

in the first frame period, before changing the anode initialization transistor from off to on, changing a scan transistor from off to on, wherein the display device comprises the scan transistor and a data line, and wherein a first electrode of the scan transistor is electrically connected to the data line.

15. The method according to claim 13, comprising:

in the first frame period, maintaining the initialization voltage at the first voltage level when the anode initialization transistor is on.

16. The method according to claim 13, wherein in the first frame period, the initialization voltage is changed from the first voltage level to the second voltage level and returned to the first voltage level before the anode initialization transistor is changed from off to on.

17. A display device comprising:

a display unit including a driving transistor and a gate initialization transistor;

a scan driver electrically connected to a gate electrode of the gate initialization transistor; and an initialization voltage generator electrically connected to a first electrode of the gate initialization transistor and configured to provide an initialization voltage to the first electrode of the gate initialization transistor, wherein a second electrode of the gate initialization transistor is electrically connected to a gate electrode of the driving transistor, wherein in a first frame period, before the scan driver changes the gate initialization transistor from on to off, the initialization voltage generator changes the initialization voltage from a first voltage level to a second voltage level and subsequently returns the initialization voltage to the first voltage, wherein the second voltage level is unequal to the first voltage level, wherein in a second frame period, before the scan driver changes the gate initialization transistor from on to off, the initialization voltage generator changes the initialization voltage from the first voltage level to at least one of the second voltage level and a third voltage level and subsequently returns the initialization voltage to the first voltage level, and wherein the third voltage level is unequal to each of the first voltage level and the second voltage level.

18. The display device according to claim 17, wherein the at least one of the second voltage level and the third voltage level includes the third voltage level, wherein the second voltage level is lower than the first voltage level, and wherein the third voltage level is higher than the first voltage level.

19. The display device according to claim 17, wherein the display unit includes an anode initialization transistor and a light emitting diode, wherein a first electrode of the anode initialization transistor is electrically connected to an anode of the light emitting diode, wherein in the first frame period, after the scan driver changes the gate initialization transistor from off to on, the scan driver changes the anode initialization transistor from off to on, and wherein in the first frame period, the initialization voltage generator maintains the initialization voltage at the first voltage level when the anode initialization transistor is on.

20. The display device according to claim 19, wherein the gate electrode of the driving transistor is initialized to the first voltage level before the anode of the light emitting diode is initialized to the first voltage level in each of the first frame period and the second frame period.

* * * * *